US010170054B2

(12) United States Patent
Park et al.

(10) Patent No.: US 10,170,054 B2
(45) Date of Patent: Jan. 1, 2019

(54) ORGANIC LIGHT EMITTING DISPLAY AND METHOD FOR DRIVING THE SAME

(71) Applicant: Samsung Display Co., Ltd., Yongin (KR)

(72) Inventors: Sang Hun Park, Cheonan-si (KR); Dong Wan Park, Gumi-si (KR); Myoung Seop Song, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 544 days.

(21) Appl. No.: 14/691,039

(22) Filed: Apr. 20, 2015

(65) Prior Publication Data

US 2016/0148569 A1 May 26, 2016

(30) Foreign Application Priority Data

Nov. 26, 2014 (KR) ..... 10-2014-0166263

(51) Int. Cl.
*G09G 3/3233* (2016.01)
*G09G 3/3275* (2016.01)

(52) U.S. Cl.
CPC ..... *G09G 3/3275* (2013.01); *G09G 3/3233* (2013.01); *G09G 2300/0814* (2013.01); *G09G 2300/0819* (2013.01); *G09G 2300/0852* (2013.01); *G09G 2300/0861* (2013.01); *G09G 2310/021* (2013.01);
(Continued)

(58) Field of Classification Search
None
See application file for complete search history.

(56) References Cited

U.S. PATENT DOCUMENTS 6,069,598 A * 5/2000 Hansen ..... G09G 3/22 345/74.1
6,147,664 A * 11/2000 Hansen ..... G09G 3/22 315/169.1
(Continued)

FOREIGN PATENT DOCUMENTS

KR 10-2006-0018764 3/2006
KR 10-2006-0124085 12/2006
(Continued)

*Primary Examiner* — Kent W Chang
*Assistant Examiner* — Nathaniel P Brittingham
(74) *Attorney, Agent, or Firm* — H.C. Park & Associates, PLC

(57) ABSTRACT

An organic light emitting display that defines a plurality of pixels arranged in a matrix form as a plurality of pixel row groups, each of which includes the same number of pixel rows and individually drives the respective pixel row groups. The organic light emitting display includes a display unit including the plurality of pixels, a plurality of data lines, and a plurality of scan lines: a scan driving unit configured to apply scan signals to the plurality of pixels; a data driving unit configured to apply data voltages that are provided to the plurality of pixels to a first output line; and a data distribution unit configured to selectively connect at least two data lines that are continuously arranged to the first output line according to demultiplexing signals. The demultiplexing signals that correspond to the pixel rows included in the respective pixel row groups have different pulse widths.

8 Claims, 9 Drawing Sheets

(52) U.S. Cl.
CPC ..... *G09G 2310/0218* (2013.01); *G09G 2310/0297* (2013.01); *G09G 2310/08* (2013.01); *G09G 2320/043* (2013.01)

(56) References Cited

U.S. PATENT DOCUMENTS 6,195,077 B1 * 2/2001 Gyouten ..... G09G 3/3692 345/100
6,429,836 B1 * 8/2002 Hansen ..... G09G 3/22 345/100
8,432,389 B2 * 4/2013 Yamamoto ..... G09G 3/3233 345/204
9,406,260 B2 * 8/2016 Jeong ..... G09G 3/3258
9,424,781 B2 * 8/2016 Park ..... G09G 3/3291
9,595,220 B2 * 3/2017 Jang ..... G09G 3/3208
2004/0150599 A1 * 8/2004 Morita ..... G09G 3/3688 345/87
2006/0267885 A1 * 11/2006 Kwak ..... G09G 3/3233 345/76
2007/0040764 A1 * 2/2007 Kim ..... G09G 3/3291 345/30
2007/0063958 A1 * 3/2007 Toyozawa ..... G09G 3/20 345/98
2007/0118781 A1 * 5/2007 Kim ..... G09G 3/3233 714/727
2008/0150844 A1 * 6/2008 Choi ..... G09G 3/3233 345/76
2011/0084947 A1 * 4/2011 Chung ..... G09G 3/3233 345/211
2011/0090137 A1 * 4/2011 Liu ..... G09G 3/3233 345/76
2011/0108844 A1 * 5/2011 Kwak ..... G09G 3/3233 257/71
2012/0098808 A1 * 4/2012 Jang ..... G09G 3/3696 345/209
2012/0293479 A1 * 11/2012 Han ..... G09G 3/003 345/212
2013/0141316 A1 * 6/2013 Lee ..... G09G 3/3266 345/76
2013/0215158 A1 * 8/2013 Fujita ..... G09G 3/3233 345/690
2013/0314310 A1 * 11/2013 Chien ..... G09G 3/3611 345/99
2014/0049531 A1 * 2/2014 Kwak ..... G09G 1/005 345/211
2014/0104328 A1 * 4/2014 Kim ..... G09G 3/3225 345/691
2014/0203262 A1 * 7/2014 Kwak ..... G09G 3/3233 257/40
2014/0347347 A1 11/2014 Jeong et al.
2015/0001504 A1 * 1/2015 Kim ..... H01L 27/32 257/40
2015/0145849 A1 * 5/2015 Choi ..... G09G 3/3233 345/212
2015/0187276 A1 * 7/2015 Shim ..... G09G 3/3233 345/77
2015/0294616 A1 * 10/2015 Jang ..... G09G 3/3208 345/691
2016/0063921 A1 * 3/2016 Tsai ..... G09G 3/3233 345/76
2016/0063922 A1 * 3/2016 Tsai ..... G09G 3/3233 345/76
2016/0071464 A1 * 3/2016 Park ..... G09G 3/3291 345/212
2016/0155379 A1 * 6/2016 Na ..... G09G 3/3233 345/215
2016/0155387 A1 * 6/2016 Kim ..... G09G 3/3291 345/76
2017/0061865 A1 * 3/2017 Park ..... G09G 3/325
2017/0069268 A1 * 3/2017 Tokunaga ..... G09G 3/3233

FOREIGN PATENT DOCUMENTS

KR 10-2009-0117209 11/2009
KR 10-2013-0096669 8/2013
KR 10-2014-0137504 12/2014

* cited by examiner

ORGANIC LIGHT EMITTING DISPLAY AND METHOD FOR DRIVING THE SAME

CROSS-REFERENCE TO RELATED APPLICATION

This application claims priority from and the benefit of Korean Patent Application No. 10-2014-0166263, filed on Nov. 26, 2014, which is hereby incorporated by reference for all purposes as if fully set forth herein.

BACKGROUND

Field

Exemplary embodiments relate to an organic light emitting display and a method for driving the same.

Discussion of the Background

An organic light emitting display that attracts attention as the next-generation display is provided with self-luminous elements that emit light, and has the advantages of a rapid response speed, high light emitting efficiency, high luminance, and wide viewing angle. The organic light emitting display has organic light emitting diodes (hereinafter referred to as "OLEDs") that are self-luminous elements.

The organic light emitting display displays an image using the organic light emitting diodes that generate light through recombination of electrons and holes. The organic light emitting display has the advantages of a rapid response speed and low power consumption. In a general organic light emitting display, current, which corresponds to a data signal that is provided from a data driving unit, is supplied to the organic light emitting diodes using transistors that are formed for respective pixels, and thus, the organic light emitting diodes emit light.

In the related art, in order to reduce the manufacturing cost and the number of data driving units that are arranged in a bezel region, a configuration, in which demultiplexers are added to be connected to output lines of the data driving units, has been proposed. The demultiplexers supply a plurality of data signals that are provided to the output lines to a plurality of data lines in a time division manner. That is, during a scan signal supply period, demultiplexer control signals are output to make the data signals output to the connected data lines. Further, in order to secure the output time of the above-described demultiplexer control signals, a driving method, which defines a plurality of pixel row groups and simultaneously perform initialization of the pixels included in the pixel row groups and threshold voltage compensation, has been proposed. That is, initialization and threshold voltage compensation are simultaneously performed with respect to the plurality of pixels included in the pixel row groups, and then data signals are applied to the pixels in accordance with scan signals and demultiplexer control signals that are sequentially applied thereto to make the pixels emit light simultaneously. Such driving is sequentially performed for the pixel row groups.

However, according to the above-described driving method, luminance deviation may occur between the first pixel row line and the last pixel row line of the pixel row group as a result of a slew rate of the data signal. That is, the luminance deviation between the last pixel row line of one pixel row group and the first pixel row line of another neighboring pixel row group may be visually recognized by a user to cause a reduction in display quality.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present invention provide an organic light emitting display that can prevent occurrence of luminance deviation between the first pixel row line and the last pixel row line of pixel row groups.

Exemplary embodiments of the present invention also provide a method for driving an organic light emitting display that can prevent occurrence of luminance deviation between the first pixel row line and the last pixel row line of pixel row groups.

Additional aspects will be set forth in the detailed description which follows, and, in part, will be apparent from the disclosure, or may be learned by practice of the inventive concept.

An exemplary embodiment of the present invention discloses an organic light emitting display that defines a plurality of pixels arranged in a matrix form as a plurality of pixel row groups, each of which includes the same number of pixel rows and individually drives the respective pixel row groups, the organic light emitting display including: a display unit including the plurality of pixels, a plurality of data lines and a plurality of scan lines that define the plurality of pixels, a scan driving unit applying scan signals to the plurality of pixels, a data driving unit applying data voltages that are provided to the plurality of pixels to a first output line, and a data distribution unit selectively connecting at least two data lines that are continuously arranged to the first output line according to demultiplexing signals. The demultiplexing signals that correspond to the pixel rows included in the respective pixel row groups have different pulse widths.

An exemplary embodiment of the present invention also discloses an organic light emitting display that defines a plurality of pixels arranged in a matrix form as a plurality of pixel row groups each of which includes the same number of pixel rows and individually drives the respective pixel row groups, the organic light emitting display including: a display unit including the plurality of pixels, a plurality of data lines and a plurality of scan lines that define the plurality of pixels, a scan driving unit applying scan signals to the plurality of pixels, a data driving unit applying data voltages that are provided to the plurality of pixels to a first output line, and a data distribution unit selectively connecting at least two data lines that are continuously arranged to the first output line according to demultiplexing signals. The pulse width of the demultiplexing signal that corresponds to a first pixel row included in the pixel row group is greater than the pulse width of the demultiplexing signal that corresponds to a last pixel row included in the pixel row group.

An exemplary embodiment of the present invention also discloses a method for driving an organic light emitting display that defines a plurality of pixels as a plurality of pixel row groups each of which includes the same number of pixel rows and individually drives the respective pixel row groups, the method comprising: applying a reference voltage to the respective pixel row groups, providing scan signals to the respective pixel row groups, inputting data voltages to the respective pixel row groups in correspondence to the scan signals, and making the respective pixel row groups emit light based on the inputted data voltages. The demultiplexing signals that correspond to the pixel rows included in the respective pixel row groups have different pulse widths.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
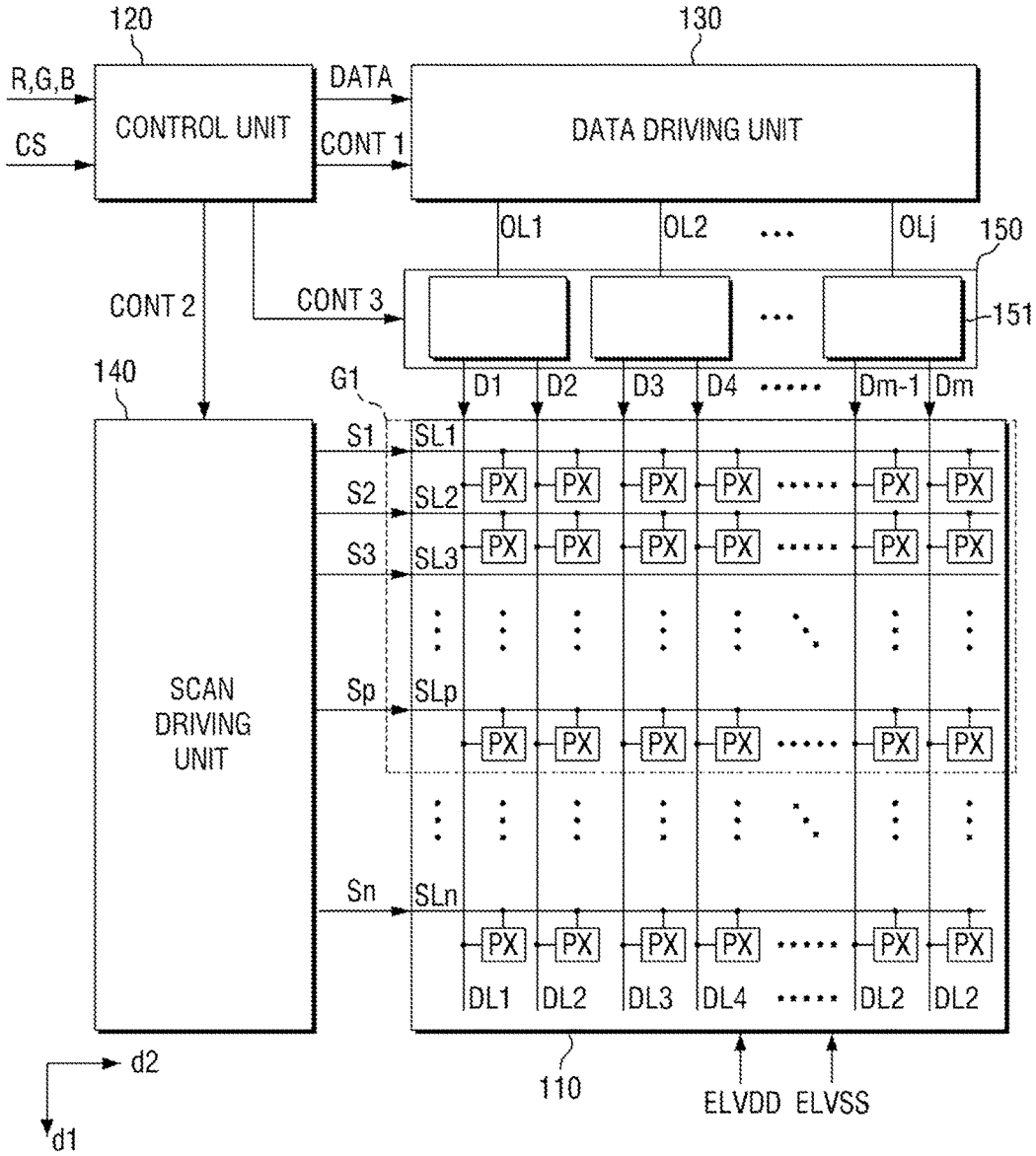
FIG. 1 is a block diagram of an organic light emitting display according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Hereinafter, exemplary embodiments of the present invention will be described in detail with reference to the accompanying drawings.

Figure 2:
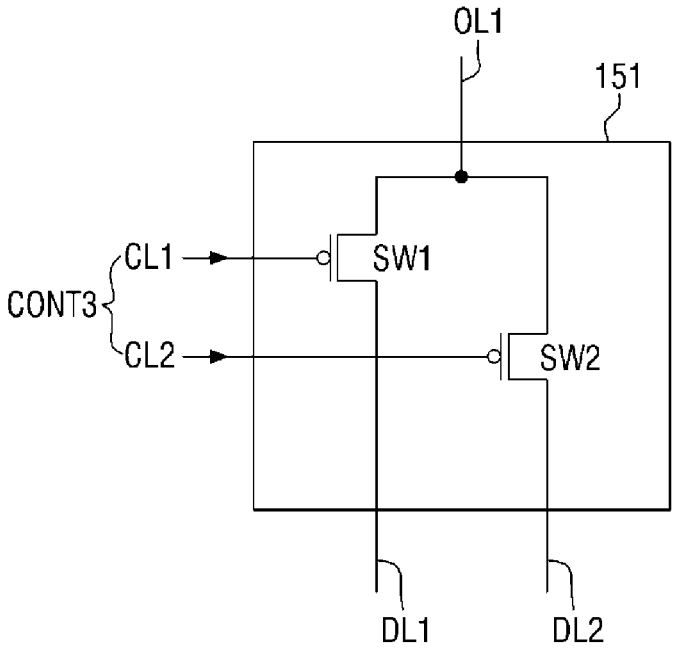
FIG. 2 is a circuit diagram schematically illustrating a demultiplexer included in a data distribution unit according to an exemplary embodiment of the present invention.
Figure 3:
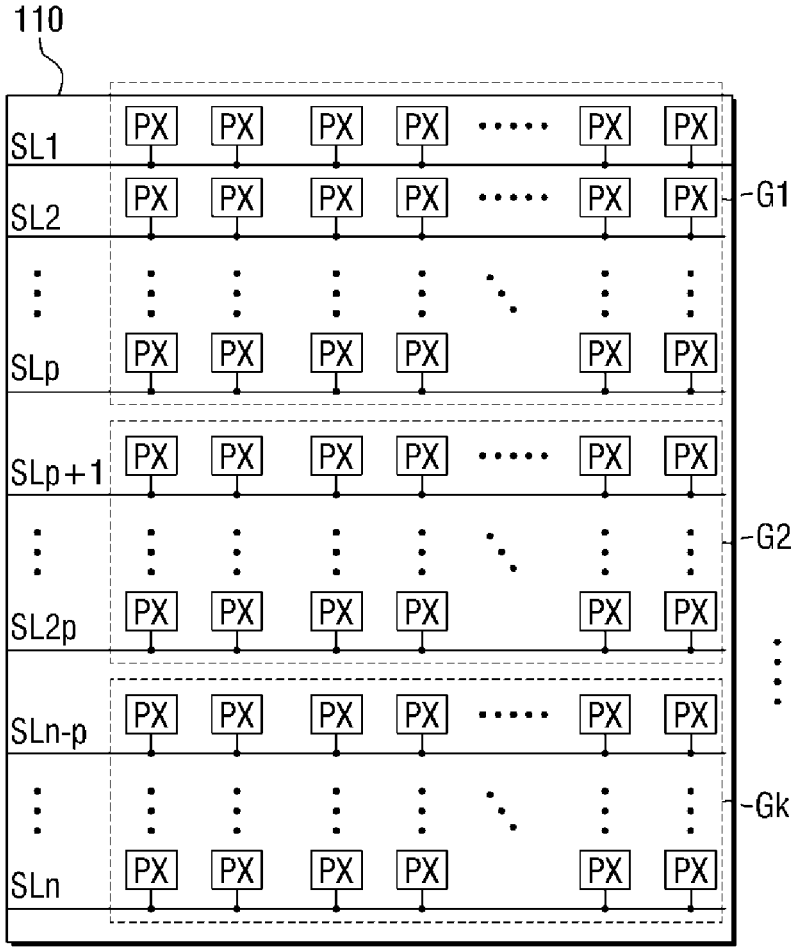
FIG. 3 is a block diagram of a display unit according to an exemplary embodiment of the present invention.

Referring to FIG. 1 to FIG. 3, an organic light emitting display 10 includes a display unit 110, a control unit 120, a data driving unit 130, a scan driving unit 140, and a data distribution unit 150.

The display unit 110 may be a region where an image is displayed. The display unit 110 may include a plurality of scan lines SL1 to SLn, a plurality of data lines DL1 to DLm that cross the plurality of scan lines SL1 to SLn, and a plurality of pixels PX, each of which is connected to one of the plurality of scan lines SL1 to SLn and one of the plurality of data lines DL1 to DLm. Here, n and m are natural numbers that are different from each other. The plurality of data lines DL1 to DLm may cross the plurality of scan lines SL1 to SLn. That is, the plurality of data lines DL1 to DLm may extend in a first direction d1, and the plurality of scan lines SL1 to SLn may extend in a second direction d2 that crosses the first direction d1. Here, the first direction d1 may be a column direction, and the second direction d2 may be a row direction. The plurality of scan lines SL1 to SLn may include the first to n-th scan lines SL1 to SLn that are arranged in order in the first direction d1. The plurality of data lines DL1 to DLm may include the first to m-th data lines DL1 to DLm that are arranged in order in the second direction d2.

The plurality of pixels PX may be arranged in a matrix. Each of the pixels PX may be connected to one of the plurality of scan lines SL1 to SLn and one of the plurality of data lines DL1 to DLm. The pixels PX may receive data voltages D1 to Dm that are applied to the connected data lines DL1 to DLm corresponding to scan signals S1 to Sn provided from the connected scan lines SL1 to SLn. That is, the scan signals S1 to Sn that are applied to the respective pixels may be provided to the scan lines SL1 to SLn, and the data voltages D1 to Dm may be provided to the data lines DL1 to DLm. The pixels PX may receive a first power voltage ELVDD through a first power line (not illustrated) and a second power voltage ELVSS through a second power line (not illustrated). Further, a first light emitting control line (not illustrated) and a second light emitting control line (not illustrated) may be connected to the pixels PX to control the light emission of the pixels. This will be described in detail later.

The control unit 120 may receive a control signal CS and video signals R, G, and B from an external system. Here, the video signals R, G, and B include luminance information of the plurality of pixels PX. The luminance may have a predetermined number of gray levels, for example, 1024, 256, or 64 gray levels. The control signal CS may include a vertical sync signal Vsync, a horizontal sync signal Hsync, a data enable signal DE, and a clock signal CLK. The control unit 120 may generate first to third driving control signals CONT1 to CONT3 and video data DATA according to the video signals R, G, and B and the control signal CS. The control unit 120 may generate the video data DATA by dividing the video signals R, G, and B in the unit of a frame according to the vertical sync signal Vsync and dividing the video signals R, G, and B in the unit of a scan line according to the horizontal sync signal Hsync. Here, the control unit 120 may compensate for the generated video data DATA. That is, the control unit 120 may compensate for luminance deviation of the video data DATA through sensing deterioration information of the respective pixels PX. However, this is merely exemplary, and data compensation that is performed by the control unit 120 is not limited to what is described above. The control unit 120 may output the video data DATA to the data driving unit 130 together with the first driving control signal CONT1. The control unit 120 may transfer the second driving control signal CONT2 to the scan driving unit 140, and may transfer the third driving control signal CONT3 to the data distribution unit 150.

The scan driving unit 140 may be connected to the plurality of scan lines of the display unit 110 and may generate the plurality of scan signals S1 to Sn according to the second driving control signal CONT2. The scan driving unit 140 may sequentially apply the plurality of scan signals S1 to Sn having a gate-on voltage to the plurality of scan lines. Here, the scan driving unit 140 may simultaneously apply the scan signals in a specific operation period. Further, the scan driving unit 140 may selectively provide the scan signals for grouped pixel lines. This will be described in more detail later.

The data driving unit 130 may be connected to the plurality of data lines of the display unit 110 and may generate the plurality of data voltages D1 to Dm through sampling and holding and converting the input video data DATA into an analog voltage according to the first driving control signal CONT1. The data driving unit 130 may output the plurality of data voltages D1 to Dm to a plurality of output lines OL1 to OLj. Each of the plurality of output lines OL1 to OLj may be connected to one of the plurality of demultiplexers 151 included in the data distribution unit 150. That is, the plurality of data voltages D1 to Dm that are generated by the data driving unit 130 may be transferred to the plurality of data lines DL1 to DLm through the data distribution unit 150.

The data distribution unit 150 may include the plurality of demultiplexers 151. Each of the demultiplexers 151 may be connected to one of the plurality of output lines OL1 to OLj. Each of the demultiplexers 151 may be connected to at least two of the plurality of data lines DL1 to DLm that are continuously arranged. That is, each of the demultiplexers 151 may selectively connect the respective connected output lines to the connected data lines according to a demultiplexing signal CL. The demultiplexing signal CL may be included in the third driving control signal CONT3 that is output from the control unit 120, as shown in FIG. 2. The third driving control signal CONT3 may include signals for controlling a start, an end, and an operation of the data distribution unit 150. Here, one of the demultiplexers 151 may selectively connect two of the data lines, that are continuously arranged, to one of the output lines. That is, one of the demultiplexer 151 may selectively connect the first output line OL1 to one of the first data line DL1 and the second data line DL2. Further, the demultiplexer 151 that is adjacent to the above-described demultiplexer 151 may selectively connect the second output line OL2 to one of the third data line DL3 and the fourth data line DL4. Hereinafter, switching of two data lines by demultiplexer 151 described. However, this is merely exemplary, and the number of data lines that can be connected to the demultiplexer 151 and the structure of the demultiplexer 151 are not limited to those as illustrated in FIGS. 1 and 2.

FIG. 2 is a circuit diagram schematically illustrating the configuration of the demultiplexer 151 that is connected to the first data line DL1 and the second data line DL2. The following explanation may also be substantially equally applied to the other demultiplexers 151 of the data distribution unit 150. The demultiplexer 151 may include a first switch SW1 controlling connection between the first data line DL1 and the first output line OL1, and a second switch SW2 controlling connection between the second data line DL2 and the first output line OL1. The demultiplexer 151 may selectively provide the data voltage that is provided through the first output line OL1 to the first data line DL1 and the second data line DL2. The first switch SW1 may be activated by the first demultiplexing signal CL1 to connect the first data line DL1 to the first output line OL1. The second switch SW2 may be activated by the second demultiplexing signal CL2 to connect the second data line DL2 to the first output line DL. The first demultiplexing signal CL1 and the second demultiplexing signal CL2 may be sequentially output during the gate-on period of the scan signal. That is, during the gate-on period of the scan signal, the demultiplexer 151 may perform switching of the first data line DL1 and the second data line DL2, and may output the first data voltage D1 to the first data line DL1 and the second data voltage D2 to the second data line DL2.

Here, although it is illustrated that the data distribution unit 150 is a separate block from the data driving unit 130, the data distribution unit 150 and the data driving unit 130 may be mounted on a board on which the display unit 110 is formed as one circuit. Because the organic light emitting display 10 according to this exemplary embodiment includes the data distribution unit 150 that is composed of the plurality of demultiplexers 151, it can be designed so that the number of the data driving units 130 is reduced and the configuration of the data driving unit 130 is simplified.

The plurality of pixels PX may receive the scan signals from the scan driving unit 140 in the unit of a pixel row, and may emit light with brightness that corresponds to the data voltages applied through the data distribution unit 150.

Here, as illustrated in FIG. 3, the plurality of pixels PX may be defined as a plurality of pixel row groups G1 to Gk. The plurality of pixel row groups G1 to Gk may include the same number of pixel rows. The plurality of pixel row groups G1 to Gk may be continuously defined. Here, the first pixel row group G1 may include pixel rows that are connected to the first to p-th scan lines SL1 to SLp, and the second pixel row group G2 may include pixel rows that are connected to the (p+1)-th to (2p)-th scan lines SLp+1 to SL2*p* (where, p is a natural number that is equal to or greater than 2). Here, the organic light emitting display 10 may be driven on the basis of the plurality of pixel row groups G1 to Gk. Specifically, the initialization and threshold voltage compensation may be performed for the respective pixel row groups, and the pixel row groups may emit light according to the data voltages that are input corresponding to the scan signals. The above-described driving processes may be sequentially performed. At the time when the first pixel row group G1 emits light, the initialization and threshold voltage compensation of the second pixel row group G2 may be performed. Further, data may be input to the pixel rows included in the respective pixel row groups according to the scan signals that are sequentially provided, but the initialization and threshold voltage compensation and light emission of the organic light emitting diodes may be simultaneously performed. Further, the demultiplexing signals that correspond to the pixel rows included in the respective pixel row groups may have different pulse widths. Hereinafter, referring to FIG. 4 to FIG. 6, the operation of the organic light emitting display according to this exemplary embodiment will be described in more detail.

Figure 4:
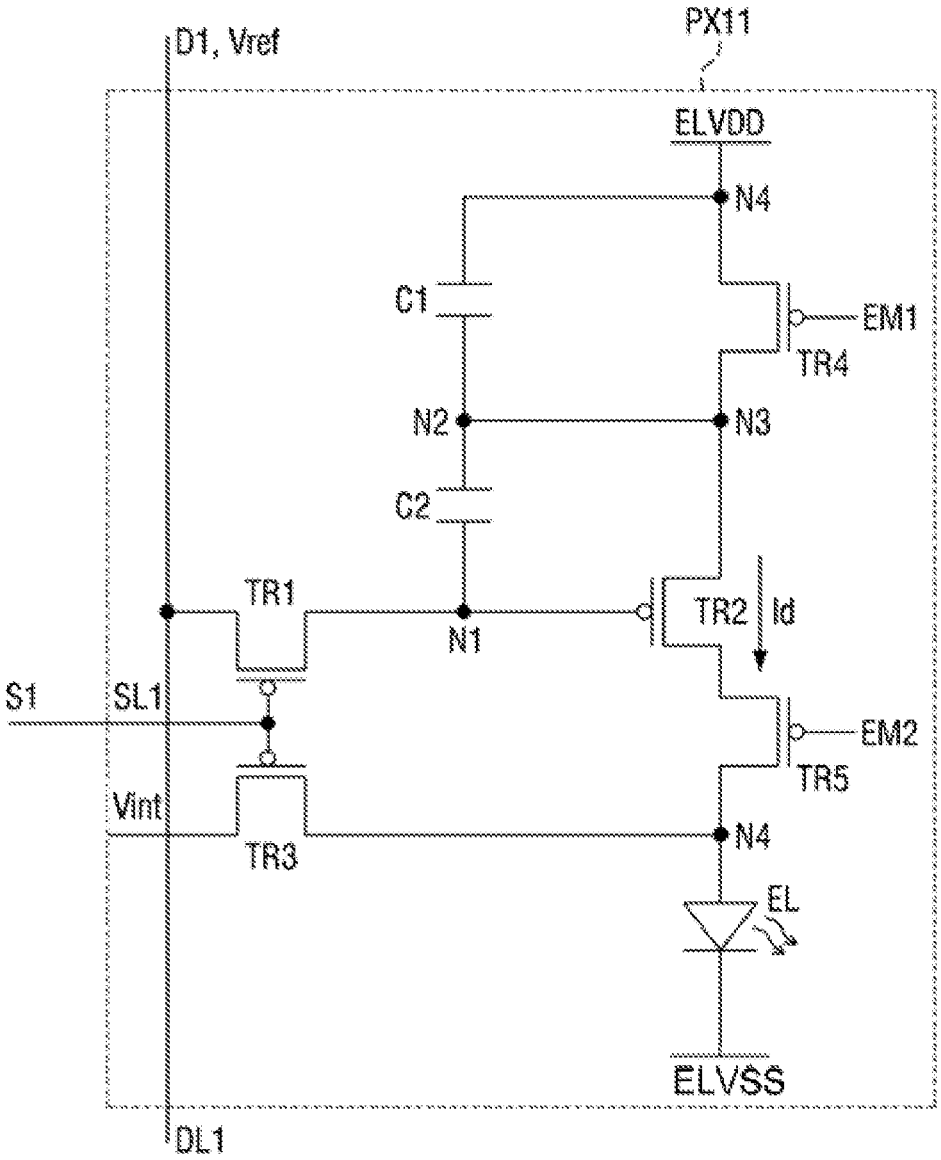
FIG. 4 is a circuit diagram illustrating one pixel of an organic light emitting display according to an exemplary embodiment of the present invention.
Figure 5:
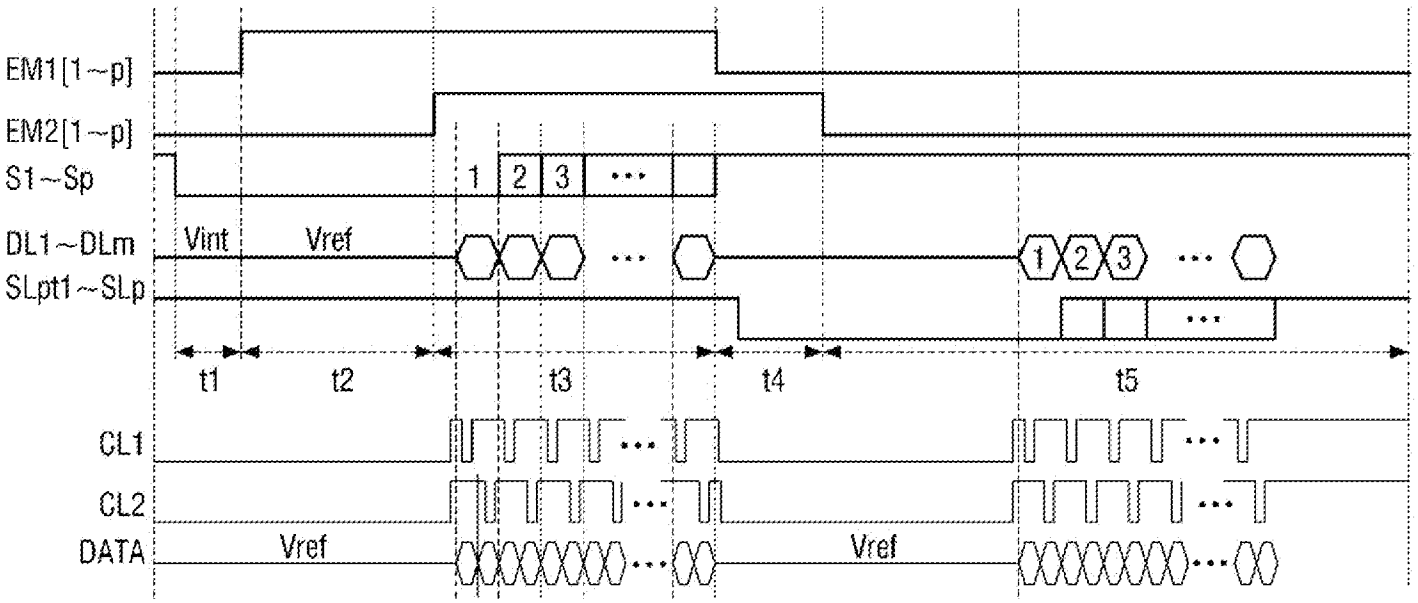
FIG. 5 is a timing diagram of an organic light emitting display according to an exemplary embodiment of the present invention.

FIG. 4 is a circuit diagram illustrating one pixel of an organic light emitting display according to an exemplary embodiment of the present invention. FIG. 5 is a timing diagram of an organic light emitting display according to an exemplary embodiment of the present invention, and FIG. 6 is an enlarged timing diagram of a third period T3 of FIG. 5.

FIG. 4 exemplarily illustrates a circuit of one pixel that is defined by the first scan line SL1 and the first data line DL1, but the pixel circuit according to this exemplary embodiment is not limited thereto.

Figure 6:
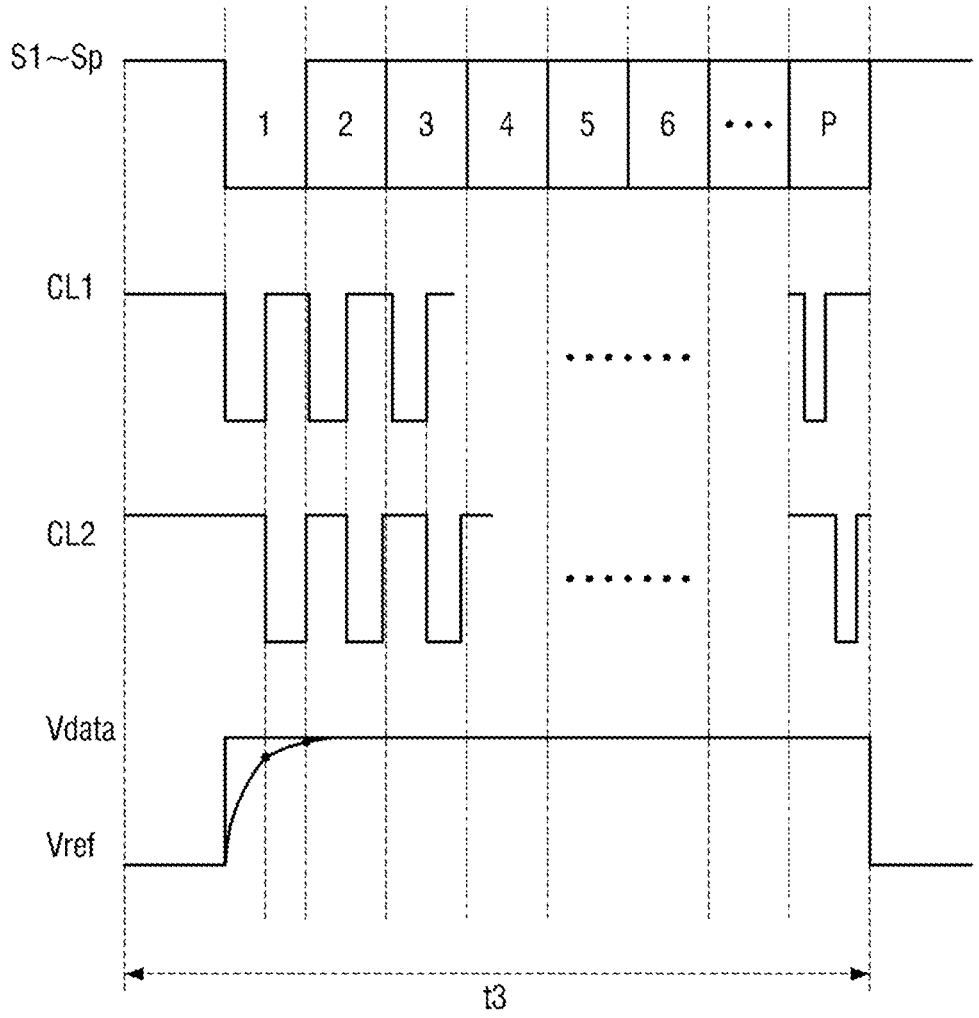
FIG. 6 is an enlarged timing diagram of a third period T3 of FIG. 5.

Referring to FIG. 4 to FIG. 6, each pixel PX of the organic light emitting display according to this exemplary embodiment may include an organic light emitting diode EL, first to fifth transistors TR1 to TR5, a first capacitor C1, and a second capacitor C2. That is, the pixel may have a 5T2 C (five transistors/two capacitors) structure.

The first transistor TR1 may include a gate electrode connected to the first scan line SL1, one electrode connected to the first data line DL1, and the other electrode connected to a first node N1. The first transistor TR1 may be turned on by the scan signal S1 having a gate-on voltage that is applied to the scan line SL1 to transfer the data voltage D1 that is applied to the data line DL1 to the first node N1. The first transistor TR1 may be a switching transistor that selectively provides the data voltage D1 to a driving transistor. Here, the first transistor TR1 may be a p-channel field effect transistor. That is, the first transistor TR1 may be turned on by the scan signal having a low-level voltage and may be turned off by the scan signal having a high-level voltage. Here, the second to fifth transistors TR2 to TR5 may be p-channel field effect transistors in all, but are not limited thereto. In other exemplary embodiments, the first to fifth transistors TR1 to TR5 may be n-channel field effect transistors.

The second transistor TR2 may include a gate electrode connected to the first node N1, one electrode connected to a third node N3, and the other electrode connected to one electrode of the fifth transistor TR5. The fifth transistor TR5 may include a gate electrode connected to a second light emission control line and the other electrode connected to a fourth node N4 that is connected to an anode electrode of the organic light emitting diode EL. Here, the second transistor TR2 may be a driving transistor which controls a driving current Id that is supplied from the first power voltage ELVDD to the organic light emitting diode EL according to the voltage of the first node N1.

The fifth transistor TR5 may interrupt a flow of the driving current Id. That is, the fifth transistor TR5 may be a second light emission control transistor that interrupts the driving current Id flowing to the organic light emitting diode EL according to a second light emission control signal EM2.

The fourth transistor TR4 may include a gate electrode connected to a first light emission control line, one electrode connected to the first power voltage ELVDD, and the other electrode connected to the third node N3. The fourth transistor TR4 may be a first light emission control transistor that controls connection between the first power voltage ELVDD and the driving transistor TR2. Here, the first power voltage ELVDD may be a high-level voltage.

The first capacitor C1 may be connected between the first power voltage ELVDD and a second node N2. The first capacitor C1 may stabilize the voltage of the second node N2. Here, the second node N2 may be equipotential to the third node N3.

The second capacitor C2 may be connected between the first node N1 and the second node N2. When the voltage of the first node N1 is changed from a reference voltage Vref to a data voltage in a data input period, the second capacitor C2 may perform coupling of the voltage of the second node N2. Further, as the high-level voltage ELVDD is supplied to the second node N2 in a light emission period, the second capacitor C2 may perform coupling of the voltage of the first node N1.

The third transistor TR3 may be an initialization transistor. Here, the third transistor TR3 may include a gate electrode connected to the first scan line SL1, one electrode to which an initialization voltage Vint is applied, and the other electrode connected to the fourth node N4. The third transistor may be turned on by the scan signal to initialize the voltages of the first node N1 and the fourth node N4.

The organic light emitting diode EL may include an anode electrode connected to the fourth node N4, a cathode electrode connected to the second power voltage ELVSS, and an organic light emitting layer (not illustrated). The organic light emitting layer may emit light having one of the primary colors, which may include, for example, red, green, and blue. A desired color may be displayed through a spatial sum or temporal sum of the three primary colors. The organic light emitting layer (not illustrated) may include low-molecular organic materials or high-molecular organic materials that correspond to the respective colors. In accordance with an amount of current that flows through the organic light emitting layer (not illustrated), the organic materials that correspond to the respective colors may emit light accordingly.

The first pixel row group G1 may operate in the manner shown in the timing diagram of FIG. 5. Here, the first pixel row group G1 may include a plurality of pixel rows connected to the first to p-th scan lines. An operation period Gt1 of the first pixel row group G1 may be divided into first to fifth periods t1 to t5.

The first period t1 may be an initialization period, the second period t2 may be a period in which the threshold voltage is compensated for, and the third period t3 may be a period in which the data voltage is written. The fourth period t4 may be a light emission preparation period, and the fifth period t5 may be a light emission period.

In the first period t1, the scan signal that is provided to the first pixel row group G1 may be applied as the gate-on voltage to turn on the first transistor TR1 and the third transistor TR3. That is, the first to p-th scan signals S1 to Sp that are applied to the first to p-th scan lines SL1 to SLp may be low-level gate-on voltages. In this case, the scan signals may be simultaneously applied. That is, initialization of the voltages charged in the previous frame may be simultaneously performed with respect to all the pixels included in one pixel row group G1. Here, the first light emission control signal EM1 and the second light emission control signal EM2 may also be provided as low-level voltages, and the fourth transistor TR4 and the fifth transistor TR5 may be in a turn-on state. In the first period t1, the initialization voltage Vint may be provided to the one electrode of the third transistor TR3. Accordingly, the voltage that is charged at the fourth node N4 may be discharged through the third transistor TR3, and in some exemplary embodiments, the initialization voltage Vint may be applied to the one electrode of the first transistor TR1 through the data line. Accordingly, the voltage that is charged at the first node N1 may be discharged through the first transistor TR1. That is, the voltage levels at the first node N1 and the fourth node N4 may be initialized to the initialization voltage Vint.

In the second period t2, the scan signal may still maintain a high level, and the first light emission control signal EM1 may change to a high level. That is, the fourth transistor TR4 may be turned off. Further, the reference voltage Vref may be applied to the data line. The reference voltage Vref that is applied to the data line may be supplied to the first node N1 through the first transistor TR1. Further, the reference voltage Vref may be supplied to the fourth node N4 that is connected to the other electrode of the second transistor TR2. That is, the reference voltage Vref may be set at the first node N1 and the fourth node N4. In this case, the reference voltage Vref is set to be less than the threshold voltage, and thus, the organic light emitting diode EL does not emit light. Further, as the fourth transistor TR4 is turned off, the second node N2 may be floated, and the voltage at the floated second node N2 may be discharged through the second transistor TR2 that is the driving transistor. Further, if the voltage of the second node N2 becomes Vref+Vth, the second transistor TR2 is turned off, and the voltage of the second node N2 may not be discharged any further from Vref+Vth. Here, the voltage of the second node N2 may be stored in the first and second capacitors C1 and C2. The threshold voltage compensation as described above may be simultaneously performed with respect to all the pixels included in the first pixel row group G1. That is, in the organic light emitting display according to an exemplary embodiment of the present invention, the initialization and threshold voltage compensation can be simultaneously performed for the defined pixel row groups. Thus, sufficient time for the data distribution unit 150 to perform demultiplexing can be secured.

Next, in the third period t3, the first to p-th scan signals S1 to Sp may be sequentially provided. That is, the pixel rows included in the first pixel row group G1 may be sequentially turned on to receive an input of the data voltage Vdata. For easy explanation of equations to be described later, the data voltage is described as Vdata in the following description. In this case, the data voltage Vdata may be demultiplexed to be distributed to the respective data lines. That is, the data voltage Vdata may be timely divided according to the demultiplexing signal to be applied to different data lines.

In the period in which the low-level gate-on voltage of the first scan signal S1 is applied, the first demultiplexing signal CL1 and the second demultiplexing signal CL2 may be sequentially output. The first demultiplexing signal CL1 and the second demultiplexing signal CL2 may be provided to the respective demultiplexers 151 included in the data distribution unit 150, and the respective demultiplexers 151 may connect the respective output lines to the data lines corresponding to the provided signals. That is, in correspondence to the low-level voltage of the first demultiplexing signal CL1, the first switch SW1 of FIG. 2, as described, above may connect the first output line OL1 to the first data line DL1 to transfer the data voltage. Further, in correspondence to the low-level voltage of the second demultiplexing signal CL2, the second switch SW2 of FIG. 2 as described above may connect the first output line OL1 to the second data line DL2 to transfer the data voltage. The second scan signal S2 may be sequentially output along with the first scan signal S1, and the first demultiplexing signal CL1 and the second demultiplexing signal CL2 that correspond to the second scan signal S2 may be output. That is, the demultiplexing signals may be sequentially output corresponding to the scan signals that are sequentially provided.

Further, in the third period t3, the second light emission control signal EM2 may change to a high level. Accordingly, the connection between the fourth node N4 and the other electrode of the driving transistor TR2 may be interrupted. The first transistor TR1 that is turned on by the first scan signal S1 may supply the data voltage Vdata to the first node N1. Further, as the voltage of the first node N1 is changed from the reference voltage Vref to the data voltage Vdata, the second capacitor C2 may perform coupling of the voltage of the second node N2 in proportion to the voltage change at the first node N1. That is, the voltage of the second node N2 may become Vref+Vth−(Vref−Vdata)(C2/(C1+C2)).

Then, in the fourth period t4, the first light emission control signal EM1 may change to a low level. Accordingly, the fourth transistor TR4 may be turned on. Further, the first transistor TR1 and the third transistor TR3 may be in a turn-off state. As the fourth transistor TR4 is turned on, the first power voltage ELVDD may be applied to the second node N2. As the voltage of the second node N2 is changed from Vref+Vth−(Vref−Vdata)(C2/(C1+C2)) to the first power voltage ELVDD, the second capacitor C2 may perform coupling of the voltage of the first node N1 in proportion to the voltage change at the second node N2. Accordingly, the voltage of the first node N1 may become Vdata+{ELVDD−Vref+Vth−(Vref−Vdata)(C2/(C1+C2))}.

The fifth period t5 may be a light emission period. That is, the second light emission control signal EM2 may change to a low level, and the second transistor TR2 may supply the driving current Id to the organic light emitting diode EL according to the voltage of the first node N1. In this case, the driving current Id that is supplied from the driving transistor TR2 to the organic light emitting diode EL may be (½)×K (Vgs−Vth). Here, K denotes a constant value that is determined by mobility and parasitic capacitance of the second transistor TR2. Further, Vg may be the voltage of the first node N1 that is Vdata+{ELVDD−Vref+Vth−(Vref−Vdata)(C2/(C1+C2))}, Vs may be the first power voltage ELVDD, and Vgs may be Vg−Vs. Accordingly, the driving current Id may have a level that corresponds to the data voltage Vdata in a state where the driving current Id is not affected by the threshold voltage Vth of the driving transistor TR2 and the first power voltage ELVDD. That is, in the organic light emitting display according to this exemplary embodiment, the characteristic deviation of the second transistor TR2 and the voltage drop of the first power voltage ELVDD may be compensated for to reduce the luminance deviation between the respective pixels PX. Here, the second light emission control signal EM2 may be simultaneously applied to all the pixels included in the pixel row group. That is, the respective pixels included in each of the pixel row groups may simultaneously emit light.

With respect to the second pixel row group G2 that is continuously defined with the first pixel row group G1, the data voltage initialization may be performed in the fourth period t4 of the first pixel row group G1. That is, the second pixel row group G2 may be independent of the first pixel row group G1, and may be sequentially driven with the first pixel row group G1 in a state where their periods partially overlap each other.

Here, the demultiplexing signals that correspond to the pixel rows included in the respective row groups may have different pulse widths. That is, the demultiplexing signals, which are output in correspondence to the respective pixel rows to multiplex the data voltages that are input to the first to p-th pixel rows included in the first pixel row group G1, may have different pulse widths. Specifically, the pulse widths of the demultiplexing signals that are output in correspondence to the first to p-th pixel rows may be sequentially decreased.

Here, before the third period t3, the respective data lines may be charged with the reference voltage Vref. In the third period t3, the data lines may be charged with the data voltages Vdata that are distributed by the demultiplexing signals CL, and the charged data voltages Vdata may be input to the respective pixel row groups. In this case, the data voltage may be input to the first pixel row of the pixel row group at the time when data charging from the reference voltage Vref to the data voltage Vdata is not completed. That is, due to the slew rate of the data voltage Vdata, the data voltage having a voltage level less than the voltage levels of the pixels charged in the other pixel rows may be input to the first pixel row of the pixel row group. Accordingly, a luminance difference may occur between the first pixel row and the other pixel rows, and such a luminance difference may greatly occur between the last pixel row of the first pixel row group and the first pixel row of the second pixel row group that are continuously arranged to be visually recognized as horizontal line inferiority.

Here, in the organic light emitting display 10 according to this exemplary embodiment, the pulse widths of the demultiplexing signals that correspond to the first to last pixel rows of the pixel row group may be sequentially decreased. That is, the pulse width of the demultiplexing signals CL1 and CL2 that are output in correspondence to the first pixel row may be greater than the pulse width of the demultiplexing signals CL1 and CL2 that are output in correspondence to the second pixel row, and the pulse width of the demultiplexing signals CL1 and CL2 that are output in correspondence to the last pixel row may be the smallest pulse width. Here, the pulse width of the demultiplexing signal may correspond to a time when the input data voltage is provided. That is, with respect to the first pixel row, the longest data voltage input time may be set in consideration of the slew rate, while with respect to the last pixel row, the shortest data voltage input time may be set in consideration of the luminance difference that occurs between the first pixel row and the last pixel row. In an exemplary embodiment, each of the pixel row groups may be composed of 8 pixel rows, and the pulse width of the demultiplexing signals corresponding to the first pixel row may be 2.5 μs, and the pulse width of the demultiplexing signals corresponding to the eighth pixel row may be 2.15 μs through sequential decrease of the pulse width by 0.05 μs. That is, in the organic light emitting display 10 according to this exemplary embodiment, the pulse widths of the demultiplexing signals corresponding to the first to last pixel rows of the pixel row group may be sequentially decreased to minimize the occurrence of the luminance difference between the respective pixel rows.

Hereinafter, another exemplary embodiment of the present invention will be described.

Figure 7:
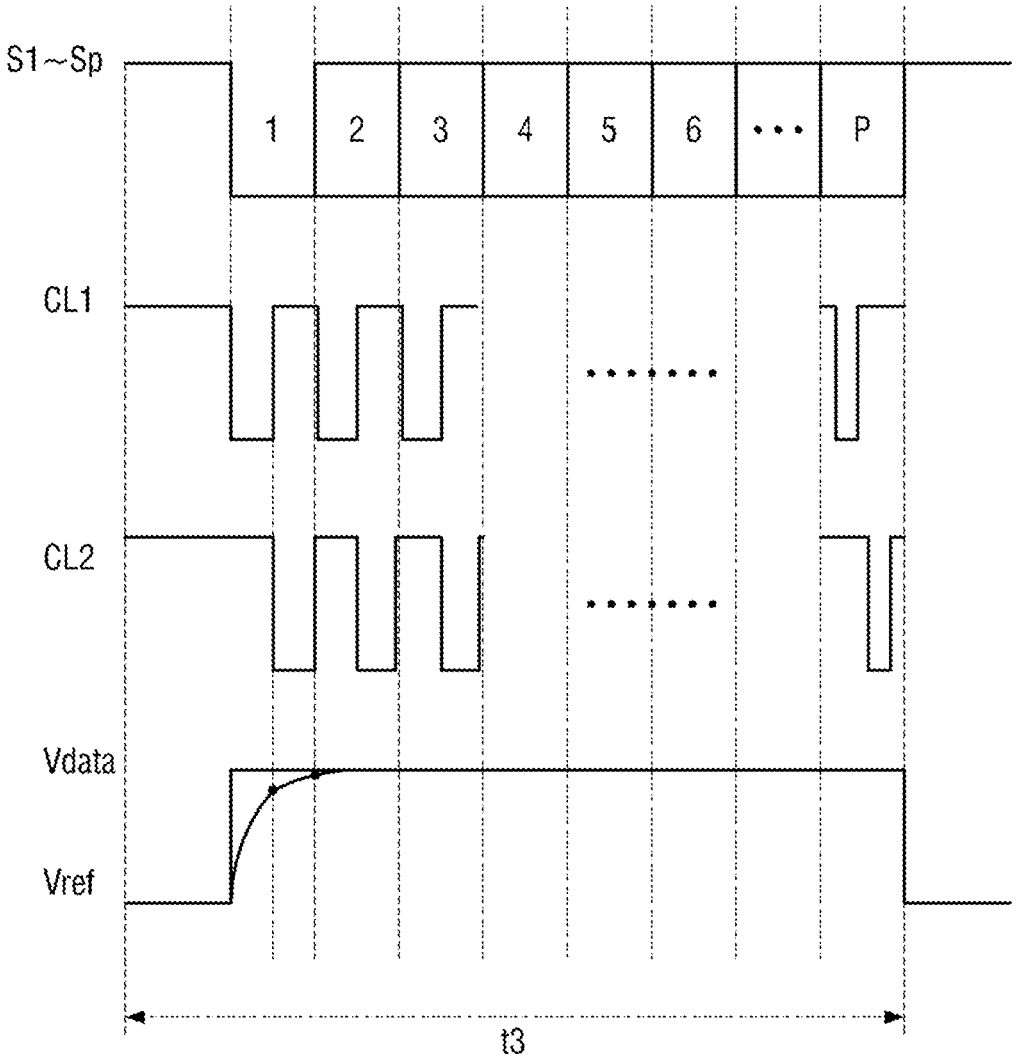
FIG. 7 is a timing diagram of a third period of an organic light emitting display according to another exemplary embodiment of the present invention.

FIG. 7 is a timing diagram of a third period of an organic light emitting display according to another embodiment of the present invention.

Referring to FIG. 7, each pixel row group may include a first sub-pixel row group in which the corresponding demultiplexing signals have a first pulse width, a second sub-pixel row group in which the corresponding demultiplexing signals have a second pulse width that is less than the first pulse width, and a third sub-pixel row group in which the corresponding demultiplexing signals have a third pulse width that is less than the first pulse width and is greater than the second pulse width. Here, the first sub-pixel row group, the second sub-pixel row group, and the third sub-pixel row group may include at least one pixel row. The first sub-pixel row group may include at least the first pixel row, and the second sub-pixel row group may include at least the last pixel row. Further, the first sub-pixel row group, the third sub-pixel row group, and the second sub-pixel row group may be sequentially arranged. That is, the pulse width of the demultiplexing signals that correspond to the first sub-pixel row group that includes the first pixel row may be set to be large in consideration of the slew rate of the data voltages Vdata. Further, the pulse width of the demultiplexing signals that correspond to the second sub-pixel row group that includes the last pixel row may be set to be small in consideration of the luminance difference between the first and last pixel rows. Further, the pulse width of the demultiplexing signals that correspond to the third sub-pixel row group that is positioned between the first sub-pixel row group and the second sub-pixel row group may be set to be middle. Accordingly, the occurrence of the luminance difference between the last pixel row of one pixel group and the first pixel row of the neighboring pixel group can be minimized.

Because the explanation of the other portions of the organic light emitting display is substantially the same as the explanation of the portions having the same titles in the organic light emitting display of FIGS. 1 to 6, the duplicate explanation thereof will be omitted.

Figure 8:
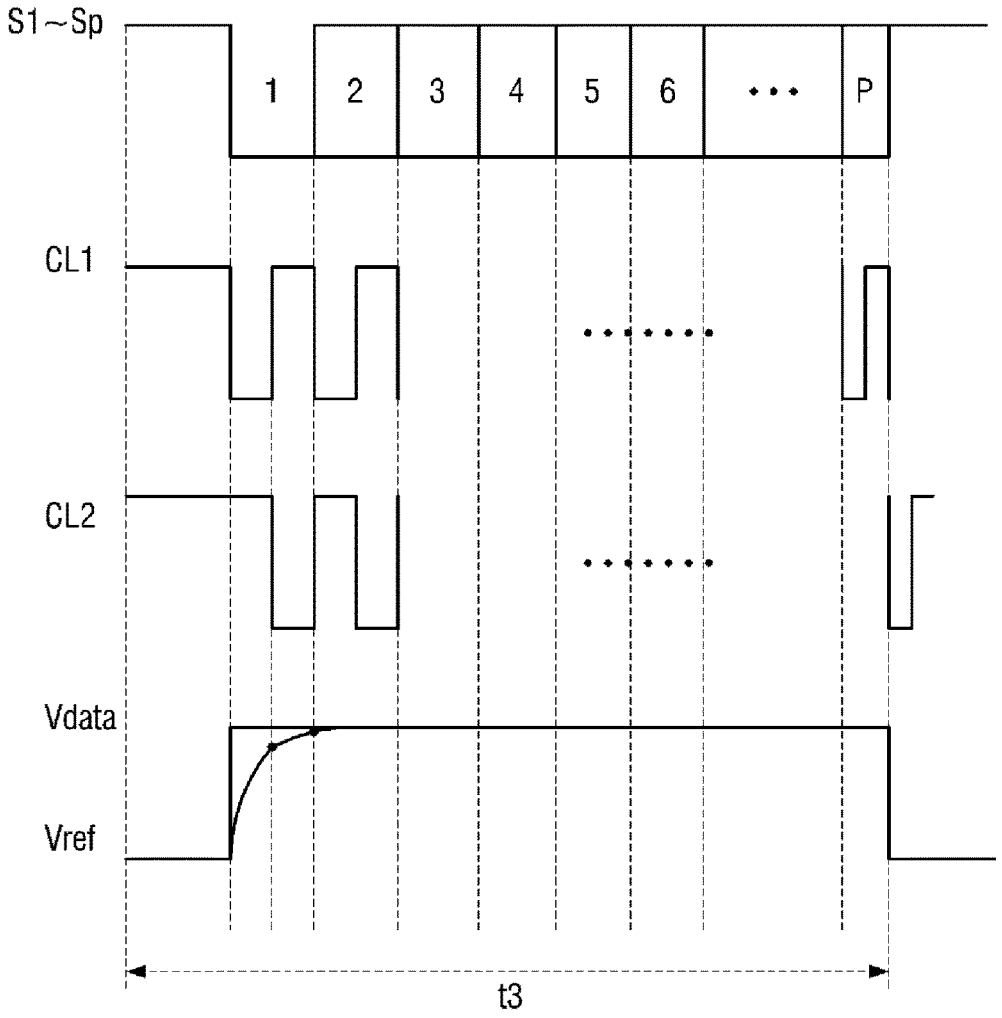
FIG. 8 is a timing diagram of a third period of an organic light emitting display according to another exemplary embodiment of the present invention.

FIG. 8 is a timing diagram of a third period of an organic light emitting display according to still another exemplary embodiment of the present invention.

Referring to FIG. 8, in the organic light emitting display according to this exemplary embodiment, the plurality of pixels PX may be defined as a plurality of pixel row groups, and may be driven for the respective pixel row groups. Here, each of the respective pixel row groups may include at least the first to p-th pixel rows. The first to p-th scan signals S1 to Sp may be sequentially provided to the first to p-th pixel rows, and the pixels included in the respective pixel rows may receive the data voltages that are applied in correspondence to the scan signals. Here, the data voltages may be distributed through the demultiplexers. In this exemplary embodiment, the first to p-th scan signals S1 to Sp may have different pulse widths. The pulse width of the first scan signal S1 that is provided to the first pixel row may be greater than the pulse width of the p-th scan signal Sp that is provided to the last pixel row. That is, in consideration of the slew rate of the data voltage Vdata, the longest gate-on voltage providing time may be set in the first scan signal S1. Because the demultiplexing signal providing time may correspond to the gate-on voltage providing time, the data voltage Vdata, which is fully charged, may be applied to the first pixel row. Accordingly, the luminance deviation between the first pixel row and another pixel row can be prevented from occurring. Further, the pulse width of the scan signal that is applied to the last pixel row of one pixel row group may be set to be small. Accordingly, the luminance deviation between the last pixel row of the one pixel row group and the first pixel row of the other neighboring pixel row group can be prevented from occurring. Specifically, in order to prevent the occurrence of the luminance deviation between the first pixel row and the p-th pixel row that is the last pixel row in the pixel row group, the pulse widths of the first to p-th scan signals S1 to Sp may be sequentially decreased, but are not limited thereto. The remaining pixel rows arranged between the first pixel row and the p-th pixel row may have a pulse width of a predetermined size. Further, the pulse widths of the demultiplexing signals that are output to correspond to the first to p-th scan signals S1 to Sp may be set to be different from each other. That is, the demultiplexing signals may be output with their pulse widths sequentially decreased. That is, according to the organic light emitting display according to this exemplary embodiment, both the pulse widths of the demultiplexing signals and the pulse widths of the scan signals are adjusted for driving for the respective pixel row groups, and thus, the occurrence of the luminance deviation can be minimized.

Because the explanation of the other portions of the organic light emitting display is substantially the same as the explanation of the portions having the same titles in the organic light emitting display of FIGS. 1 to 6, the duplicate explanation thereof will be omitted.

Figure 9:
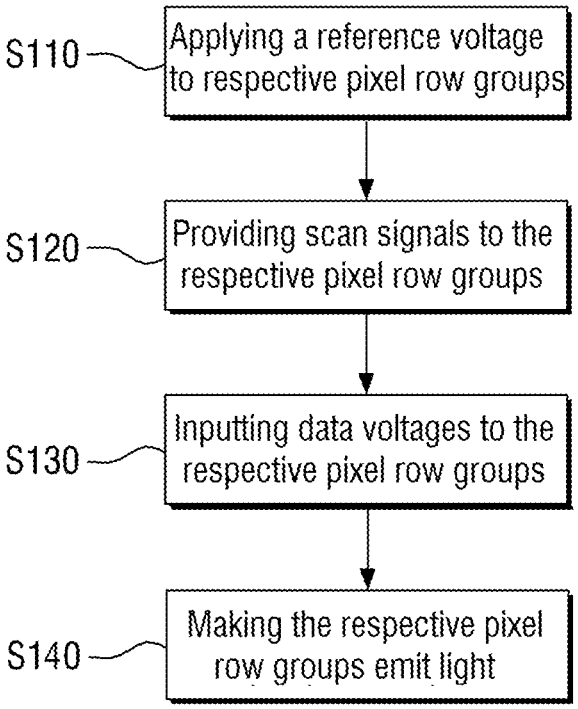
FIG. 9 is a flow chart illustrating a method for driving an organic light emitting display according to an exemplary embodiment of the present invention.

Hereinafter, a method for driving an organic light emitting display according to an exemplary embodiment of the present invention, as illustrated in FIG. 9, will be described.

A method for driving an organic light emitting display according to an exemplary embodiment of the present invention includes applying a reference voltage to respective pixel row groups (S110), providing scan signals to the respective pixel row groups (S120), inputting data voltages corresponding to the respective pixel row groups (S130), and making the respective pixel row groups emit light based on the inputted data voltages (S140). According to the method for driving an organic light emitting display, a plurality of pixels PX may be defined as a plurality of pixel row groups G1 to Gk, each of which includes the same number of pixel rows, and the respective pixel row groups may be individually driven. The respective pixel row groups may be sequentially driven. Hereinafter, the method for driving an organic light emitting display according to this exemplary embodiment will be described on the basis of one pixel row group. However, the method can be applied to other pixel row groups in the same manner. For easy explanation of the method, FIG. 9 in combination with FIGS. 4 and 5 may be referred to.

First, the reference voltage is applied to the respective pixel row groups (S110).

The applying the reference voltage (S110) may occur during a period that corresponds to the second period t2 illustrated in FIG. 5. The reference voltage Vref may be a voltage for compensating for the threshold voltage of the driving transistor. In an exemplary embodiment, before the reference voltage Vref is applied, the voltages formed on the gate electrode and the other electrode of the driving transistor may be initialized to the initialization voltage Vint. Here, the reference voltage Vref may be applied to the first node N2 and the fourth node N4 through the first transistor TR1 and the third transistor TR3. Because the voltage change resulting from the applying of the reference voltage Vref is substantially the same as that as described above, the duplicate explanation thereof will be omitted.

Next, the scan signals are provided (S120).

Each of the respective pixel row groups may include the first to p-th pixel rows, and the corresponding first to p-th scan signals S1 to Sp may be sequentially provided to the first to p-th scan lines SL1 to SLp. The first transistor TR1 included in each of the pixels may be turned on in correspondence to the gate-on voltage of the scan signal.

Here, the first to p-th scan signals S2 to Sp may have different pulse widths. The pulse width of the first scan signal S1 that is provided to the first pixel row may be greater than the pulse width of the p-th scan signal Sp that is provided to the last pixel row. That is, in consideration of the slew rate of the data voltage Vdata, the longest gate-on voltage providing time may be set in the first scan signal S1. Because the demultiplexing signal providing time may correspond to the gate-on voltage providing time, the data voltage Vdata, which is fully charged, may be applied to the first pixel row. Accordingly, the luminance deviation between the first pixel row and another pixel row can be prevented from occurring.

Then, the data voltages are input (S130).

The data voltages Vdata may be input in correspondence to the first to p-th scan signals S1 to Sp. Here, the data voltages Vdata may be demultiplexed to be distributed to the respective data lines. That is, the data voltages Vdata may be timely divided according to the demultiplexing signals to be applied to different data lines. The demultiplexing signals may be sequentially output in correspondence to the scan signals that are sequentially provided, and may be output in accordance with the number of data lines that are distributed during the scan-on time of the scan signals. Here, the demultiplexing signals that correspond to the pixel rows included in the respective pixel row groups may have different pulse widths. For demultiplexing of the data voltages that are input to the first to p-th pixel rows, the demultiplexing signals that are output to correspond to the respective pixel rows may have different pulse widths. Here, the pulse width of the demultiplexing signal that is output in correspondence to the first pixel row may be greater than the pulse width of the demultiplexing signal that is output in correspondence to the last pixel row. Further, the demultiplexing signals may have the pulse widths that are sequentially decreased. That is, with respect to the first pixel row, the longest data voltage input time may be set in consideration of the slew rate, while with respect to the last pixel row, the shortest data voltage input time may be set in consideration of the luminance difference that occurs between the first pixel row and the last pixel row. Accordingly, the occurrence of the luminance difference between the respective pixel rows can be minimized.

Then, the respective pixel row groups are made to emit light based on the inputted data voltages (S140).

The organic light emitting diode EL may emit light in correspondence to the input data voltage Vdata. The driving current Id for making the organic light emitting diode EL may have a level that corresponds to the data voltage Vdata in a state where the driving current Id is not affected by the threshold voltage Vth of the driving transistor TR2 and the first power voltage ELVDD. Further, because the pulse width of the demultiplexing signal and/or the pulse width of the scan signal are controlled in consideration of the slew rate of the data voltage Vdata, the luminance deviation of the pixel rows of the respective pixel row groups can be minimized.

Because the explanation of the other portions of the method for driving an organic light emitting display is substantially the same as the explanation of the portions having the same titles included in the organic light emitting display of FIGS. 1 to 6, the duplicate explanation thereof will be omitted.

According to exemplary embodiments of the present invention, at least the following effects can be achieved.

Because the luminance deviation of the display unit is not substantially visually recognized, the display quality can be improved.

The effects according to the present invention are not limited to the contents as exemplified above, but further various effects are included in the description.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light emitting display that defines a plurality of pixels arranged in a matrix as a plurality of pixel row groups, each of which comprises the same number of pixel rows and individually drives the respective pixel row groups, the organic light emitting display comprising:

a display unit comprising the plurality of pixels, a plurality of data lines, and a plurality of scan lines;

a scan driving unit configured to apply scan signals to the plurality of pixels;

a data driving unit configured to apply data voltages, that are to be provided to the plurality of pixels, to a first output line; and a data distribution unit including a plurality of demultiplexers, each demultiplexer comprising two switches configured to selectively connect at least two data lines that are continuously arranged to the first output line according to at least two demultiplexing signals, each switch controlling connection between its respective data line and the first output line in response to receiving one of said demultiplexing signals, wherein;

the demultiplexing signals that correspond to the pixel rows included in the respective row groups have different pulse widths, a first pulse width of each of the demultiplexing signals that corresponds to a first pixel row of the pixel row group is greater than a last pulse width of each of the demultiplexing signals that corresponds to a last pixel row of the pixel row group; and the demultiplexing signals are sequentially output corresponding to the scan signals that are sequentially output.

2. The organic light emitting display of claim 1, wherein the pulse widths of the demultiplexing signals are sequentially decreased.

3. The organic light emitting display of claim 1, wherein one of the pulse widths of each of the demultiplexing signals that corresponds to at least one of the pixel rows between the first pixel row and the last pixel row is less than the first pulse width of each of the demultiplexing signals that corresponds to the first pixel row and is greater than the last pulse width of each of the demultiplexing signals that corresponds to the last pixel row.

4. A method for driving an organic light emitting display that includes a plurality of demultiplexers, a plurality of pixels, a plurality of data lines, and a plurality of scan lines, and defines the plurality of pixels as a plurality of pixel row groups, each of which includes the same number of pixel rows and individually drives the respective pixel row groups, the method comprising:

applying a reference voltage to the respective pixel row groups;

providing scan signals to the respective pixel row groups;

inputting data voltages, that are to be provided to the respective pixel row groups in correspondence to the scan signals, to a first output line;

making the respective pixel row groups emit light based on the inputted data voltages; and selectively connecting at least two data lines that are continuously arranged to the first output line according to at least two demultiplexing signals, wherein each demultiplexed signal is applied to one of two switches that comprise a single demultiplexer, each switch controlling connection between its respective data line and said first output line, wherein;

the demultiplexing signals that correspond to the pixel rows included in the respective row groups have different pulse widths, a first pulse width of each of the demultiplexing signals that corresponds to a first pixel row of the pixel row group is greater than a last pulse width of each of the demultiplexing signals that corresponds to a last pixel row of the pixel row group; and the demultiplexing signals are sequentially output corresponding to the scan signals that are sequentially output.

5. The method of claim 4, wherein the pulse widths of the demultiplexing signals are sequentially decreased.

6. The method of claim 4, further comprising applying an initialization voltage to the respective pixel row groups before the reference voltage is applied.

7. The method of claim 4, wherein the reference voltage is simultaneously applied to the pixel rows included in the respective pixel row groups.

8. The method of claim 4, wherein the respective pixel row groups are sequentially driven.

* * * * *